US008711172B2

(12) United States Patent
Bae et al.

(10) Patent No.: US 8,711,172 B2
(45) Date of Patent: Apr. 29, 2014

(54) DITHERING METHOD AND APPARATUS

(75) Inventors: Cheon-Ho Bae, Chungcheongbuk-do (KR); Jun-Hyoung Myoung, Chungcheongbuk-do (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 821 days.

(21) Appl. No.: 12/542,257

(22) Filed: Aug. 17, 2009

(65) Prior Publication Data

US 2010/0060660 A1 Mar. 11, 2010

(30) Foreign Application Priority Data

Sep. 5, 2008 (KR) ..... 10-2008-0087733

(51) Int. Cl.
*G09G 5/02* (2006.01)

(52) U.S. Cl.
USPC ..... 345/596; 345/599

(58) Field of Classification Search
None
See application file for complete search history.

(56) References Cited

U.S. PATENT DOCUMENTS 6,469,708 B1 * 10/2002 Wu et al. ..... 345/596
2005/0021579 A1 1/2005 Bae et al.
2005/0195144 A1 * 9/2005 Kwon et al. ..... 345/89
2006/0087696 A1 * 4/2006 Lee ..... 358/3.13
2007/0091042 A1 * 4/2007 Chung et al. ..... 345/88
2008/0068293 A1 * 3/2008 Ishii ..... 345/3.1
2008/0204384 A1 * 8/2008 Lee et al. ..... 345/83
2009/0019336 A1 * 1/2009 Liao et al. ..... 714/755

FOREIGN PATENT DOCUMENTS

JP 1997-018723 1/1997
KR 10-0520298 2/2005
KR 10 2006 0019822 A 3/2006

OTHER PUBLICATIONS

Japanese Office Action issued on Mar. 12, 2013 in counterpart Japanese Patent Application No. 2009-193038 (3 pages in Japanese).
Chinese Office Action issued on Mar. 29, 2013 in counterpart Chinese Patent Application No. 200910172045.6 (11 pages including English Translation)

* cited by examiner

*Primary Examiner* — Kee M Tung
*Assistant Examiner* — Sing-Wai Wu
(74) *Attorney, Agent, or Firm* — NSIP Law

(57) ABSTRACT

A dithering method prevents the gray level saturation in a gray level region having high luminance and expresses all gray levels. The dithering method includes performing the temporal/spatial compensation on input data, generating dithering data by adding a head bit to the data on which the temporal/spatial compensation is performed, and selecting a corresponding gamma voltage according to the dithering data.

35 Claims, 9 Drawing Sheets

FIG. 1
(PRIOR ART)

| TRUNCATION SCHEME | | | | | |
|---|---|---|---|---|---|
| 8-BIT INPUT DATA | | | 6-BIT OUTPUT DATA | | REMARKS |
| DECIMAL NUMBER | BINARY NUMBER | | DECIMAL NUMBER | BINARY NUMBER | |
| 0 | 0000 0000 | | 0 | 00 0000 | SAME GRAY LEVEL |
| 1 | 0000 0001 | | | 00 0000 | |
| 2 | 0000 0010 | | | 00 0000 | |
| 3 | 0000 0011 | | | 00 0000 | |
| 4 | 0000 0100 | | 1 | 00 0001 | SAME GRAY LEVEL |
| 5 | 0000 0101 | | | 00 0001 | |
| 6 | 0000 0110 | | | 00 0001 | |
| 7 | 0000 0111 | | | 00 0001 | |
| • • • | | | | | |
| 248 | 1111 1000 | | 62 | 11 1110 | SAME GRAY LEVEL |
| 249 | 1111 1001 | | | 11 1110 | |
| 250 | 1111 1010 | | | 11 1110 | |
| 251 | 1111 1011 | | | 11 1110 | |
| 252 | 1111 1100 | | 63 | 11 1111 | SAME GRAY LEVEL |
| 253 | 1111 1101 | | | 11 1111 | |
| 254 | 1111 1110 | | | 11 1111 | |
| 255 | 1111 1111 | | | 11 1111 | |

FIG. 2
(PRIOR ART)

| 8-BIT INPUT DATA | | FILTERED OUTPUT DATA | | WEIGHT | | | | 6-BIT OUTPUT DATA |
|---|---|---|---|---|---|---|---|---|
| DECIMAL NUMBER | BINARY NUMBER | MSB 6 BITS | LSB 2 BITS | 1ST FRAME | 2ND FRAME | 3RD FRAME | 4TH FRAME | |
| 0 | 0000 0000 | 00 0000 | 00 | | | | | MSB 6 BITS + WEIGHT |
| 1 | 0000 0001 | 00 0000 | 01 | | | | | |
| 2 | 0000 0010 | 00 0000 | 10 | | | | | |
| 3 | 0000 0011 | 00 0000 | 11 | | | | | |
| 4 | 0000 0100 | 00 0001 | 00 | - | - | - | - | |
| 5 | 0000 0101 | 00 0001 | 01 | - | - | - | +1 | |
| 6 | 0000 0110 | 00 0001 | 10 | +1 | - | +1 | - | |
| 7 | 0000 0111 | 00 0001 | 11 | +1 | +1 | +1 | - | |
| 8 | 0000 1000 | 00 0010 | 00 | - | - | - | - | |
| ⋮ | | | | | | | | |
| 248 | 1111 1000 | 11 1110 | 00 | - | - | - | - | GRAY LEVEL UNCHANGED (OVERFLOW OCCURRED) |
| 249 | 1111 1001 | 11 1110 | 01 | - | - | - | +1 | |
| 250 | 1111 1010 | 11 1110 | 10 | +1 | - | +1 | - | |
| 251 | 1111 1011 | 11 1110 | 11 | +1 | +1 | +1 | - | |
| 252 | 1111 1100 | 11 1111 | 00 | - | - | - | - | |
| 253 | 1111 1101 | 11 1111 | 01 | - | - | - | +1 | |
| 254 | 1111 1110 | 11 1111 | 10 | +1 | - | +1 | - | |
| 255 | 1111 1111 | 11 1111 | 11 | +1 | +1 | +1 | - | |

DITHERING METHOD AND APPARATUS

CROSS-REFERENCE TO RELATED APPLICATIONS

The present invention claims priority of Korean Patent Application No. 10-2008-0087733, filed on Sep. 5, 2008, which is incorporated herein by reference in its entirety.

BACKGROUND OF THE INVENTION

1. Field of the Invention

The present invention relates to an image output system, and more particularly, to a dithering method and apparatus of the image output system, capable of displaying an image without reducing the number of gray levels of input data of a high gray level image.

2. Description of Related Art

An image output system is developing as various devices such as a cathode-ray tube (CRT), a liquid crystal display (LCD), a plasma display panel (PDP) and a mobile display. A typical method for outputting an image may include converting a practical image to a digitalized signal, performing image processing on the digitalized signal, and displaying the processed video signal through the image output system. In the above processing sequence, the image output system should output an image closest to the practical image. That is, data to be lost in the process of digitalizing the practical image should be minimized and an amount of lost data of the image-processed image should be minimized. The process of digitalizing the practical image includes a sequence of processes such as sampling, quantization and normalization. One object of the sequence of processing signals is to minimize data to be lost so that digital data are closest to the practical image.

The image output system is an apparatus for displaying the processed image to be visible to the naked eye, but it has limitations. That is, the image output system has a limitation in the number of gray levels that it can express. For instance, when each of R, G and B video signals consists of 8 bits, one video signal can express $2^8$ numbers of gray levels. By synthesizing the R, G and B video signals, it is possible to express $2^8 \times 2^8 \times 2^8$ numbers of colors, i.e., $2^{24}$ numbers of colors. However, if the image output system outputs an 8-bit video signal as a 6-bit signal, each video signal cannot express $(2^8-2^6)$ numbers of gray levels and thus it cannot express $(2^{24}-2^8)$ numbers of colors. Therefore, the image output system expressing the number of gray levels that is smaller than that of an original video signal employs dithering technology to implement an image closest to the practical image.

Each of pixels constructing one image includes 3 sub-pixels consisting of R, G and B. Each of the sub-pixels is provided with a video signal. If the number of gray levels of the video signal coupled to each sub-pixel is reduced, a false contour line generating an obvious contour line at a boundary of a screen may be generated or a Mach's phenomenon of generating a bright or dark band on the screen may occur.

Since the false contour line or the Mach's phenomenon generates the obvious contour line that does not exist in the practical image, it becomes a cause of deteriorating image quality. Thus, in order that the false contour line or the Mach's phenomenon is not generated, the dithering is performed to smoothly process the obvious contour line by intentionally inputting noises to data or pixels at a boundary of the image. In general, in case a bit width of a video source is greater than that of the image output system, the following two schemes may be used.

The first one is a truncation scheme.

The truncation scheme is technology of simply removing lower 2 bits of a video signal coupled to a pixel. For instance, in case the video signal has 8 bits, 6 bits except the lower 2 bits are outputted as an output signal. When constructing a screen by inputting the signal of 6 bits to the pixel, since the number of gray levels of one sub-pixel becomes $2^6$, the boundary of the image may be definitely outstood.

FIG. 1 shows a truth table representing the truncation scheme.

Referring to FIG. 1, in case input data has 8 bits, since decimal numbers 0, 1, 2 and 3 are outputted as 0 without discrimination in a process of expressing the input data with 6 bits, the image displayed through the image output system may have a false contour line unlike the practical image.

The second one is a temporal/spatial compensation scheme.

The temporal/spatial compensation scheme is technology of applying a spatial effect of reflecting lower 2 bits onto a pixel and a line by determining positions of the pixel and the line to be compensated and a temporal effect of reflecting the lower 2 bits to each frame, with reference to the lower 2 bits to be discarded in case input data has 8 bits and output data has 6 bits. That is, the temporal/spatial compensation scheme is a scheme of expressing the output data of 6 bits closer to 8 bits. The reflection of the lower 2 bits is to compensate the lower 2 bits that become a weight to a line and a pixel positioned in each frame.

Table 1 represents the temporal/spatial compensation scheme according to the lower 2 bits.

TABLE 1

| Lower 2 bits | $1^{st}$ frame | $2^{nd}$ frame | $3^{rd}$ frame | $4^{th}$ frame |
|---|---|---|---|---|
| 00 | 0 | 0 | 0 | 0 |
| 01 | 0 | +1 | 0 | 0 |
| 10 | +1 | 0 | +1 | 0 |
| 11 | +1 | 0 | +1 | +1 |

As described in Table. 1, for one pixel of each of the first to fourth frames, a weight 1(100) is added to higher 6 bits except the lower 2 bits among bits of the input data or the higher 6 bits are outputted just the same according to a value of the lower 2 bits.

If the lower 2 bits to be discarded have a value of '11' and the value is maintained for the 4 frames, the output data loses a value, i.e., 3 (value of lower 2 bits, 11)×4 (no. of frames) =12. A method for compensating the lost value is to add 1(100) to higher 6 bits of corresponding pixels of the first, third and fourth frames and to output higher 6 bits of a corresponding pixel of the second frame just the same. If the compensation is completed, a value, 4(100)×3 (no. of frames where 1 is added)=12, is compensated and thus the compensated value always becomes equal to the value lost during the 4 frames.

For one more example, in case the lower 2 bits to be discarded have a value '10', the output data loses a value, i.e., 2 (value of lower 2 bits, 10)×4 (no. of frames)=8. A method for compensating the lost value is to add 1(100) to higher 6 bits of corresponding pixels of the first and third frames and to output higher 6 bits of corresponding pixels of the second and fourth frames just the same. If the compensation is completed, a value, 4(100)×2 (no. of frames where 1 is added)=8, is compensated and thus the compensated value always becomes equal to the value lost during the 4 frames.

There is no limitation in the position of a frame where the weight 1 is added in the temporal/spatial compensation scheme. For instance, in case the lower 2 bits to be discarded have the value of '11', the weight is applied to pixels of 3 frames among continuous 4 frames. In case the lower 2 bits to be discarded have the value of '10', the weight is applied to pixels of 2 frames among the continuous 4 frames.

However, the temporal/spatial compensation scheme according to the prior art has the following problems.

FIG. 2 provides a truth table representing the conventional temporal/spatial compensation scheme in case an input video signal has 8 bits. FIG. 3 illustrates a graph showing output performance when an output signal is normalized in a range of 0 to 100 according to the conventional temporal/spatial compensation scheme.

As shown in FIG. 2, the overflow may occur when performing the temporal compensation for a gray level greater than a decimal number 252 among the 8 bits of the input video signal. Therefore, although the temporal/spatial compensation scheme is applied, the compensation cannot be implemented. In this case, as shown in FIG. 3, the gray level saturation may occur in higher gray levels of input data regardless of the input variation. Therefore, when performing the dithering by applying the conventional temporal/spatial compensation scheme, there may be caused a problem of not expressing high luminance parts stably.

SUMMARY OF THE INVENTION

An embodiment of the present invention is directed to providing a dithering method capable of preventing the gray level saturation in a gray level region having high luminance and expressing all gray levels.

Another embodiment of the present invention is directed to providing a dithering apparatus capable of preventing the gray level saturation in a gray level region having high luminance and expressing all gray levels.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an aspect of the present invention, there is provided a dithering method including: performing the temporal/spatial compensation on input data; generating dithering data by adding a head bit to the data on which the temporal/spatial compensation is performed; and selecting a corresponding gamma voltage according to the dithering data.

In accordance with another aspect of the present invention, there is provided a dithering apparatus including: a compensation sector configured to perform the temporal/spatial compensation according to a gray level of input data and output dithering data by adding a head bit to the data on which the temporal/spatial compensation is performed; a gamma voltage generating sector configured to generate a plurality of main gamma voltages and a dummy gamma voltage; and a gamma voltage selecting sector configured to select the main gamma voltages or the dummy gamma voltage according to the dithering data.

BRIEF DESCRIPTION OF THE DRAWINGS

FIG. 1 illustrates a truth table representing a truncation scheme.

FIG. 2 illustrates a truth table representing a conventional temporal/spatial compensation scheme.

DESCRIPTION OF SPECIFIC EMBODIMENTS

Figure 3:
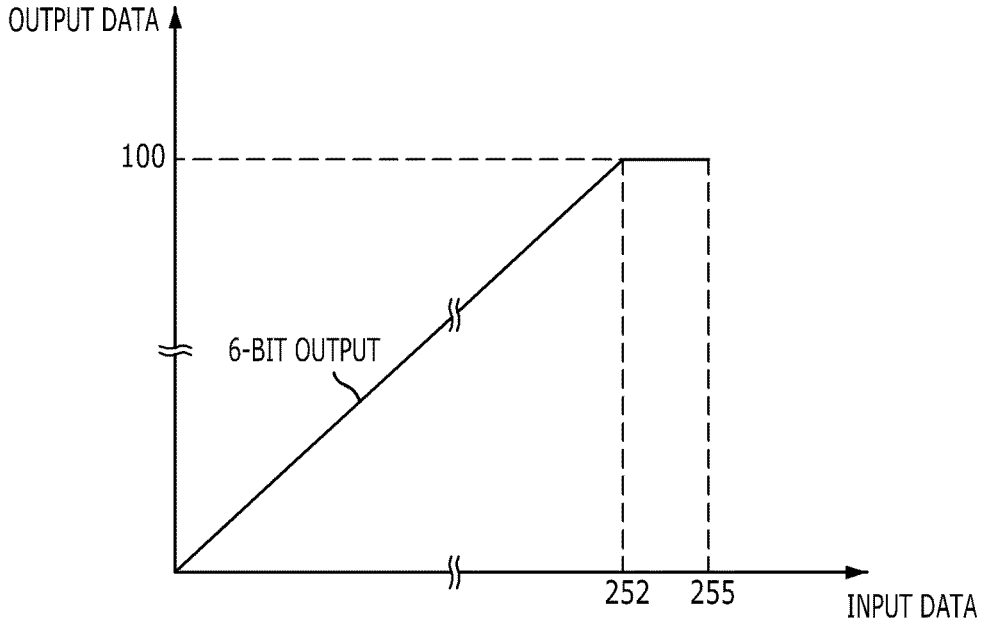
FIG. 3 (PRIOR ART)
FIG. 3 illustrates a graph showing data output performance according to the conventional temporal/spatial compensation scheme.

The advantages, features and aspects of the invention will become apparent from the following description of the embodiments with reference to the accompanying drawings, which is set forth hereinafter. Moreover, in this description, all variables represented by 'N', 'K' and 'M' are natural numbers. Like reference numerals refer to like elements throughout.

Figure 4:
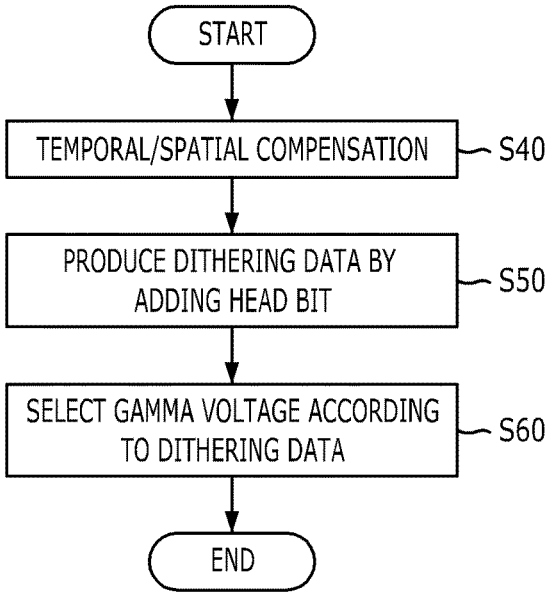
FIG. 4 illustrates a flowchart of a dithering method in accordance with an embodiment of the present invention.

FIG. 4 illustrates a flowchart of a dithering method in accordance with an embodiment of the present invention.

Referring to FIG. 4, in step S40, the temporal/spatial compensation is performed by applying a dither matrix to higher bits of input data according to a gray level of the input data.

The temporal/spatial compensation is performed in a manner of time-averaging during 4 frames.

As described in FIG. 1, the truncation scheme loses data corresponding to a value, i.e., decimal number 2 (data)×4 (no. of frames)=8, during 4 frames in case lower 2-bit data is a binary number '10'. However, like in FIG. 2, since the compensation is completed for higher 6 bits in 2 frames among the 4 frames in the temporal compensation scheme, a value, i.e., '4 (compensation)×2 (no. of frames)=8', can be compensated. That is, in case of converting 8-bit data to 6-bit data, extinct gray levels can be completely recovered.

Theoretically, all gray levels can be expressed without the loss of gray levels through the temporal compensation scheme, but practically undesired dither noise may be generated, so that the image quality may be deteriorated. Therefore, to overcome this problem, the spatial compensation is performed.

The spatial compensation employs a dither matrix like employing a 3×3 or 5×5 window matrix when processing a 2D image. Since the image quality is changed according to a pattern (weight) and size of the dither matrix, the pattern (weight) and size of the dither matrix are also important matters. Therefore, it is important to introduce the optimized size and pattern of the dither matrix.

Figure 5:
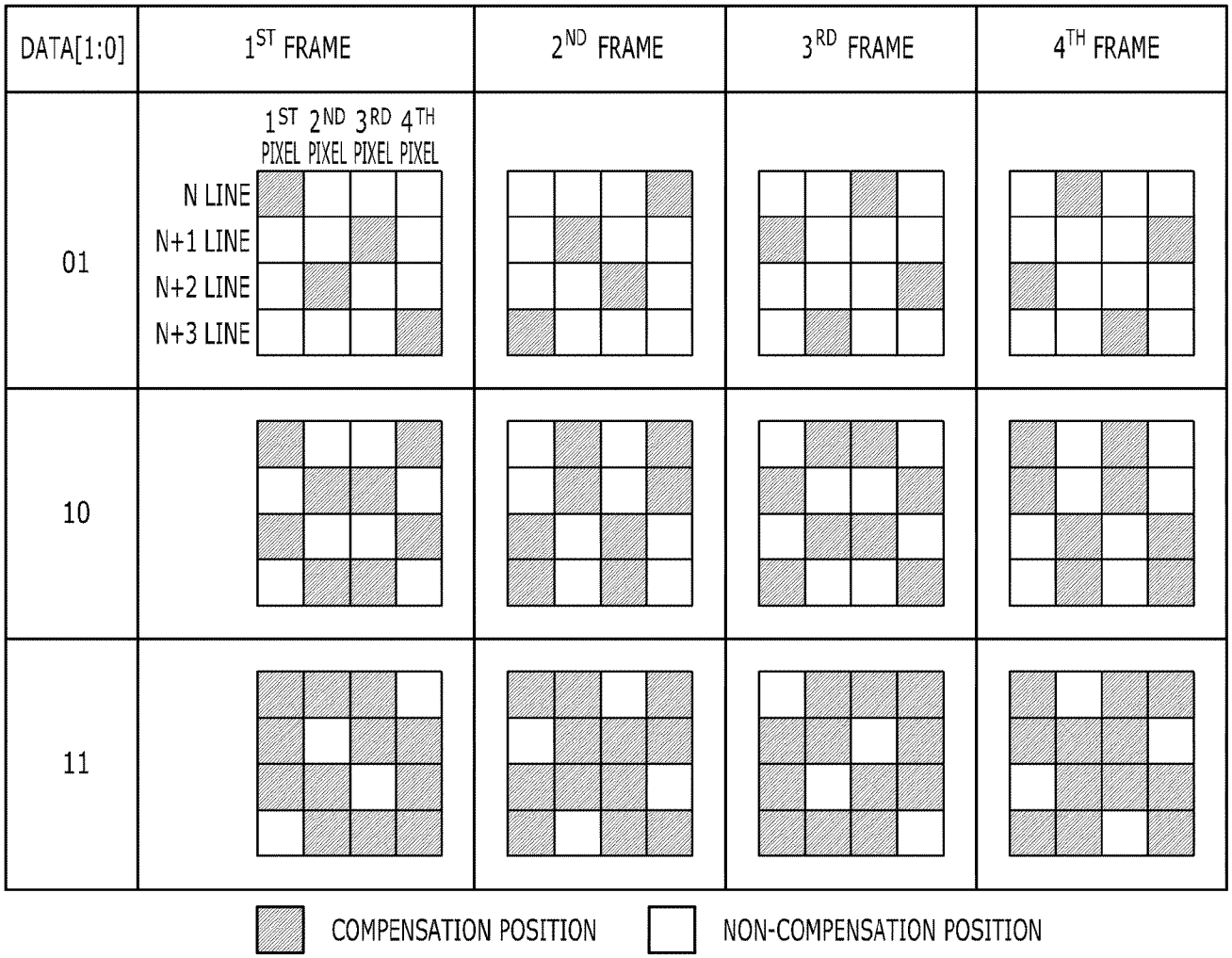
FIG. 5 illustrates forms of dither matrices of an R data channel.
Figure 6:
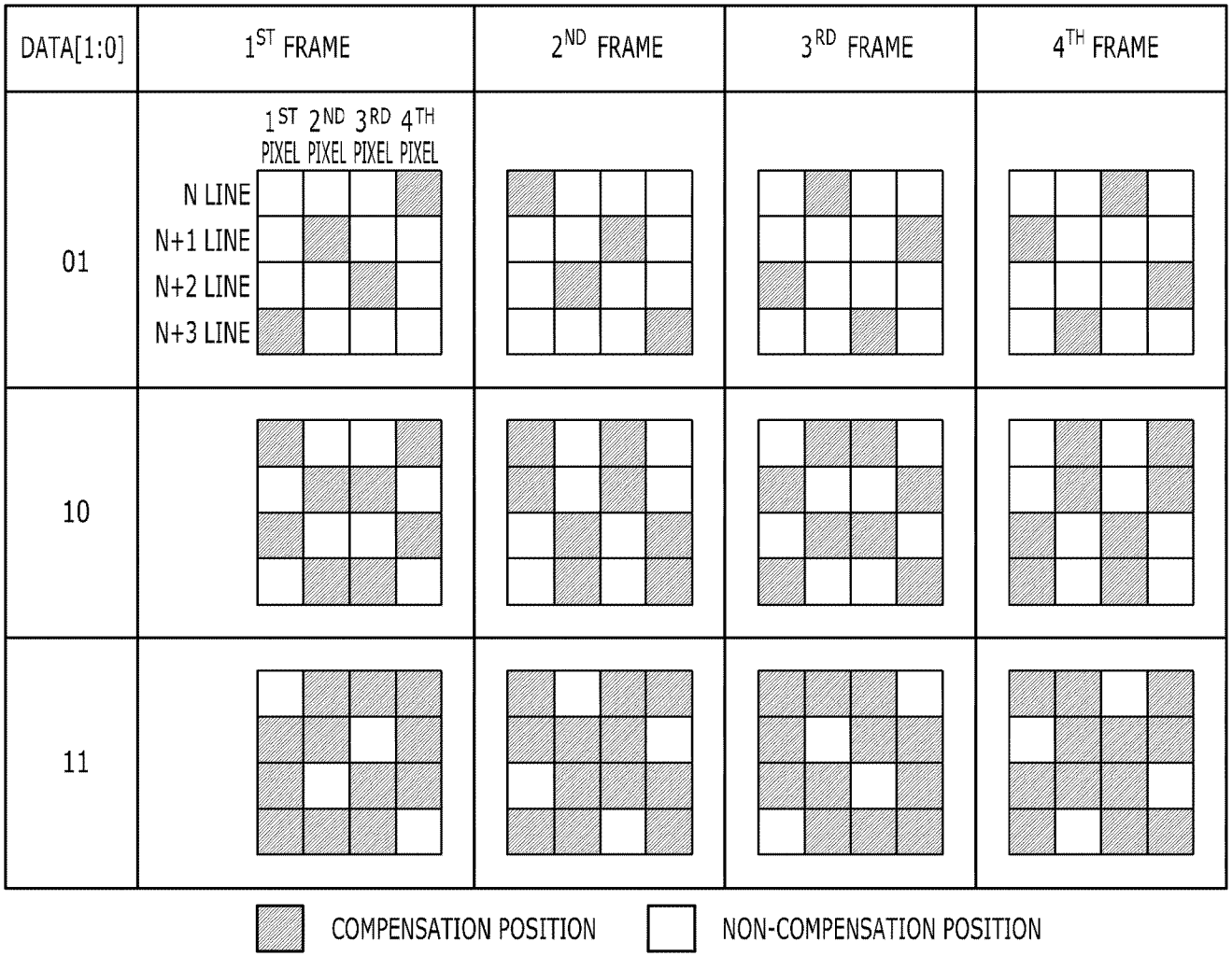
FIG. 6 illustrates forms of dither matrices of a G data channel.
Figure 7:
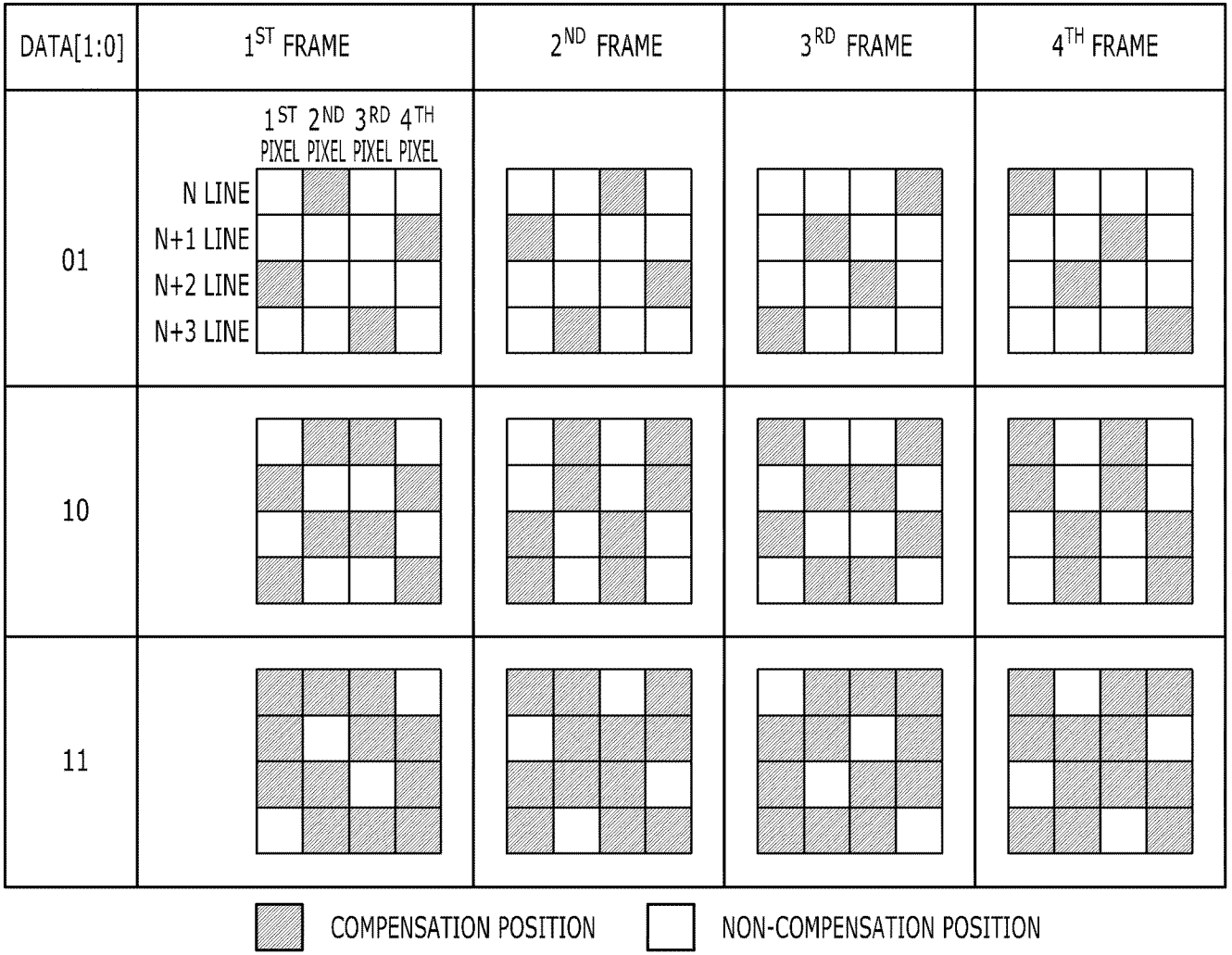
FIG. 7 illustrates forms of dither matrices of a B data channel.

As described in FIGS. 5 to 7, in embodiments of the present invention, dither matrices having a 4×4 form are employed.

The dither matrices illustrated in FIG. 5 are basic forms and they are applied to an R data channel among pixel (R, G and B) data channels. Although the dither matrices illustrated in FIG. 5 can be also applied to the G data channel and the B data channel, applying different dither matrices to the R, G and B data channels results in obtaining good image quality.

The dither matrices illustrated in FIG. 6 are patterns obtained by performing vertical mirroring or horizontal mirroring on the basic dither matrices illustrated in FIG. 5. Applying the dither matrices illustrated in FIG. 6 to the G data channel results in obtaining much better image quality.

The dither matrices illustrated in FIG. 7 are patterns obtained by performing frame-inversion on the dither matrices for the G data channel illustrated in FIG. 6. It is preferable to apply the dither matrices illustrated in FIG. 7 to the B data channel.

Then, in step S50, dithering data is generated by adding a head bit to data on which the temporal/spatial compensation is performed. The head bit becomes the most significant bit of the dithering data. The head bit may be a binary number '0' or '1' according to the gray level of the input data.

For instance, when the input data has 8 bits and higher bits are 6 bits, in case the gray level of the input data is smaller than or equal to a 248 gray level, a binary number '0' is added as the head bit to data for which the temporal/spatial compensation is completed, i.e., higher bit data. Furthermore, in case the gray level of the input data is greater than the 248 gray level, a binary number '0' or '1' is added as the head bit to the data for which the temporal/spatial compensation is completed according to the gray level of the input data. Moreover, in case the gray level of the input data corresponds to a 252 gray level, a binary number '1' is added as the head bit. In case the gray level of the input data corresponds to a 255 gray level, a binary number '0' is added as the head bit.

Subsequently, in step S60, a corresponding gamma voltage is selected according to the dithering data. At this time, the gamma voltage includes a plurality of main gamma voltages or at least one dummy gamma voltage.

The number of main gamma voltages is determined according to K higher bits of the input data. That is, the number of main gamma voltages is $2^K$. For instance, if K is 6, the number of main gamma voltages becomes total 64 of $2^0$th to $2^K$th. Herein, the main gamma voltages have voltage levels rising as going from $2^0$th to $2^K$th. That is, the $2^0$th main gamma voltage has the lowest voltage level and the $2^K$th main gamma voltage has the greatest voltage level. The dummy gamma voltage has a different voltage level from those of the $2^0$th to $2^K$th main gamma voltages and may have a voltage level existing between the $2^0$th main gamma voltage and the $2^K$th main gamma voltage. Preferably, the dummy gamma voltage has a voltage level existing between the $(2^K-1)$th main gamma voltage and the $2^K$th main gamma voltage.

In the step S60, when the dummy gamma voltage has a voltage level existing between the $(2^K-1)$th main gamma voltage and the $2^K$th main gamma voltage, a method for selecting the gamma voltage will be described hereinafter.

For example, if the gray level of the input data is smaller than or equal to a preset reference gray level, one of the $2^0$th main gamma voltage to the $(2^K-1)$th main gamma voltage is selected according to the dithering data. Preferably, one of the $2^0$th main gamma voltage to the $(2^K-1)$th main gamma voltage is selected according to remaining bits except the head bit among the dithering data. Meanwhile, if the gray level of the input data is greater than the preset reference gray level, one of the $(2^K-1)$th main gamma voltage, the dummy gamma voltage and the $2^K$th main gamma voltage is selected according to the dithering data.

As another example, in case the input data has N bits and the gray level of the input data is a $2^N$th gray level, the $2^K$th main gamma voltage having the greatest voltage level is selected among the main gamma voltages. In case the gray level of the input data is a $(2^N-7)$th gray level, the $(2^K-1)$th main gamma voltage is selected. In case the gray level of the input data is a $(2^N-3)$th gray level, the dummy gamma voltage is selected. In case the gray level of the input data exists between the $(2^N-3)$th gray level and the $2^N$th gray level, the dummy gamma voltage or the $2^K$th main gamma voltage is selected according to the head bit of the dithering data. In case the gray level of the input data exists between the $(2^N-7)$th gray level and the $(2^N-3)$th gray level, the $(2^K-1)$th main gamma voltage or the dummy gamma voltage is selected according to the dithering data including the head bit.

The processes of the steps S50 and S60 will be described with reference to FIGS. 8 and 9.

In the embodiments of the present invention, in case the input data, i.e., an input video signal, has N bits, an (N−M)-bit signal expresses all gray levels. The input video signal may have 8 bits or 10 bits. In accordance with the embodiment of the present invention, the input video signal has 8 bits.

Figure 8:
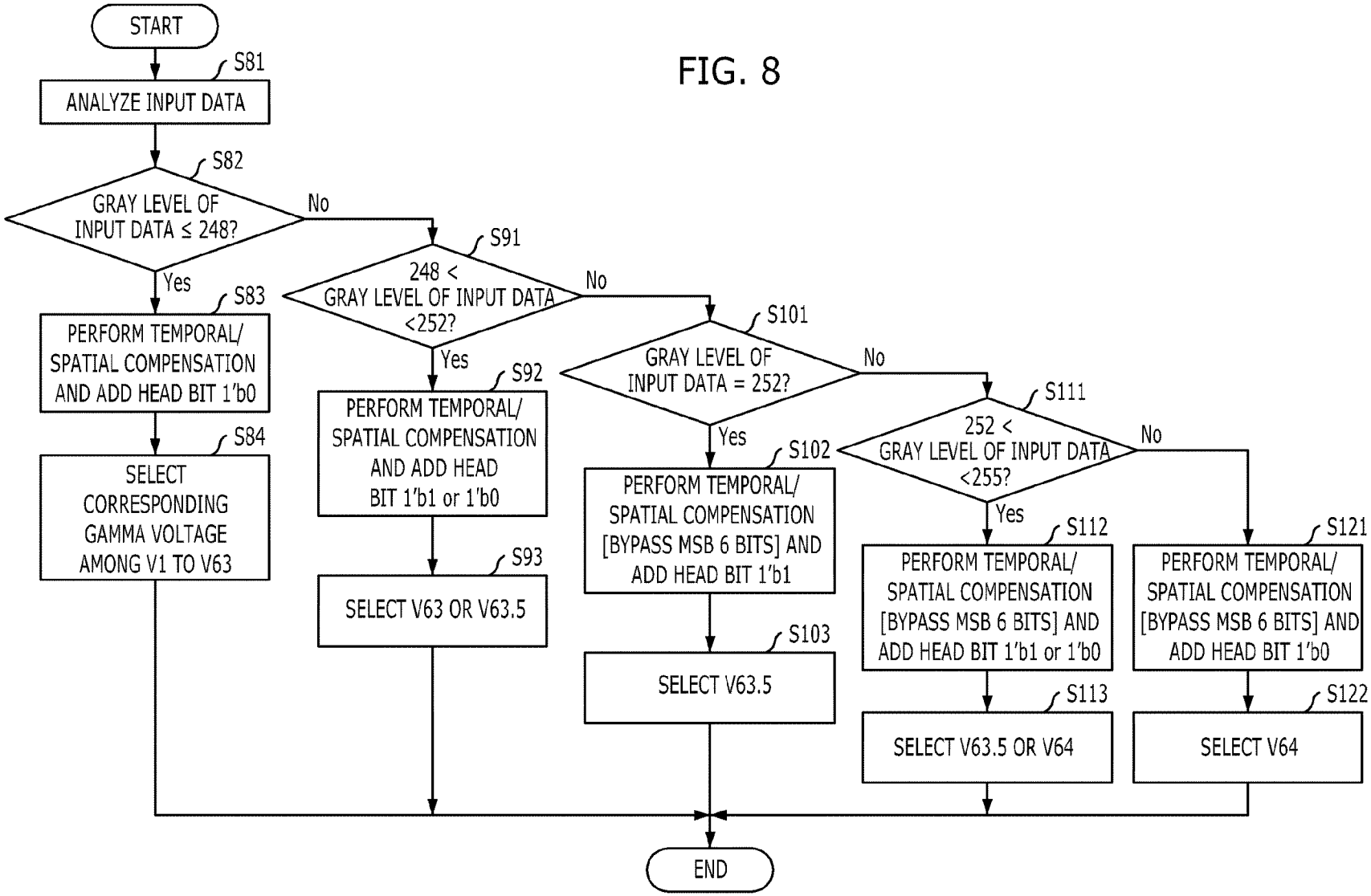
FIG. 8 illustrates a detailed flowchart of the dithering method described in FIG. 4.
Figure 9:
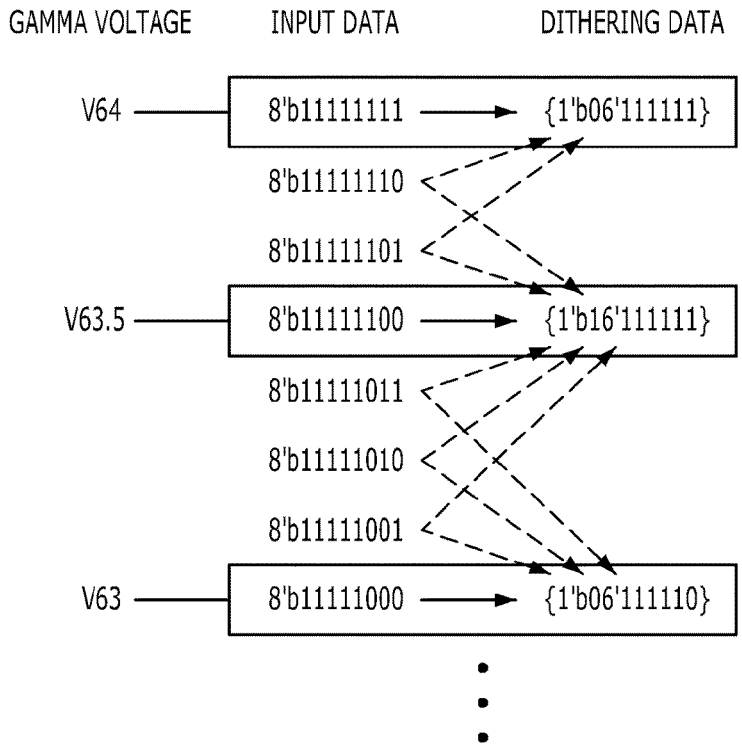
FIG. 9 illustrates a conceptual view of a gamma voltage selection scheme in the dithering method described in FIG. 8.

Referring to FIGS. 8 and 9, in step S81, input data is received and a gray level of the input data is analyzed and compared.

In steps S82 and S83, in case the gray level of the input data is smaller than or equal to a preset reference gray level, e.g., a 248 gray level, after or at the same time of performing the temporal/spatial compensation on higher 6 bits of the input data, a head bit is added and the head bit becomes a binary number '0' (b0) as one bit (1').

In steps S91 and 92, in case the gray level of the input data is greater than the 248 gray level and smaller than a 252 gray level, after or at the same time of performing the temporal/spatial compensation on the higher 6 bits of the input data, the head bit is added and the head bit becomes a binary number '1' (b1) or '0' (b0) as one bit (1').

In steps S101 and S102, in case the gray level of the input data is equal to the 252 gray level, i.e., the gray level of the input data is 252, after or at the same time of performing the temporal/spatial compensation on the higher 6 bits of the input data, the head bit is added and the head bit becomes the binary number '1' (b1) as one bit (1').

In steps S111 and S112, in case the gray level of the input data is greater than the 252 gray level and smaller than a 255 gray level, i.e., the gray level of the input data is a 253 or 254 gray level, after or at the same time of performing the temporal/spatial compensation on the higher 6 bits of the input data, the head bit is added and the head bit becomes the binary number '1' (b1) or '0' (b0) as one bit (1').

In step S121, in case the gray level of the input data is equal to the 255 gray level, i.e., the gray level of the input data is 255, after or at the same time of performing the temporal/spatial compensation on the higher 6 bits of the input data, the head bit is added and the head bit becomes the binary number '0' (b0) as one bit (1').

The temporal compensation performed in the steps S83 and S92 is implemented in a manner of adding a weight to the higher 6 bits according to the lower 2 bits. However, in the steps S102, S112 and S121, the higher 6 bits are bypassed regardless of the lower 2 bits to prevent the overflow. That is, when performing the temporal compensation, a weight for the higher 6 bits becomes an integer '0' regardless of the lower 2 bits. Moreover, after performing the temporal/spatial compensation, the head bit is differently applied to distinguish from the same gray levels as bits except the head bit in the dithering data.

Four frames may be designated for the temporal/spatial compensation performed in the steps S83, S92, S102, S112 and S121. A dither matrix on which the temporal/spatial compensation is to be performed is selected in a selected frame. As illustrated in FIGS. 5 to 7, the dither matrices of data channels of corresponding pixels, e.g., R, G and B, are applied. Herein, if the input data corresponds to a compensation position, data for which the temporal/spatial compensation is completed has a value obtained by adding an integer '1' to the higher 6 bits. On the other hand, if the input data corresponds to a non-compensation position, data for which the temporal/spatial compensation is completed has a value obtained by adding an integer '0' to the higher 6 bits.

As described above, in the steps S83, S92, S102, S112 and S121, the head bit is added to the data for which the temporal/spatial compensation is completed. The head bit may be added in the process of performing the temporal/spatial compensation. In case the gray level of the input data is 248, the binary number '0' is added as the head bit to the data for which the temporal/spatial compensation is completed. In case the gray level of the input data is 252, the binary number '1' is added as the head bit to the data for which the temporal/spatial compensation is completed. In case the gray level of the input data is 255, the binary number '0' is added as the head bit to the data for which the temporal/spatial compensation is completed. That is, in case the gray level of the input data is 248, the dithering data becomes '0111110' and, in case the gray level of the input data is 255, the dithering data becomes '1111111'. In case the gray level of the input data is 255, the dithering data becomes '0111111'. If the gray level of the input data exists between 248 and 255 except 248, 252 and 255, the binary number '0' or '1' is appropriately added as the head bit to the dithering data.

After the temporal/spatial compensation is completed, in step S84, if the gray level of the input data is smaller than or equal to the 248 gray level, i.e., the gray level of the input data is in a range of 0 to 248 gray levels, one of a $2^0$th main gamma voltage V1 to a $(2^6-1)$th main gamma voltage V63 is selected according to the dithering data.

In step S93, if the gray level of the input data is greater than the 248 gray level and smaller than the 252 gray level, i.e., the gray level of the input data is one of the 249, 250 and 251 gray levels, the $(2^6-1)$th main gamma voltage V63 or a dummy gamma voltage V63.5 is selected according to the dithering data.

In step S103, if the gray level of the input data is equal to the 252 gray level, the dummy gamma voltage V63.5 is selected.

In step S113, if the gray level of the input data is greater than the 252 gray level and smaller than the 255 gray level, i.e., the gray level of the input data is the 253 or 254 gray level, the dummy gamma voltage V63.5 or a $2^6$th main gamma voltage V64 is selected according to the head bit.

In step S122, if the gray level of the input data is equal to the 255 gray level, the $2^6$th main gamma voltage V64 is selected.

Then, the gamma voltage selected according to the input data is amplified and outputted to an image display.

Figure 10:
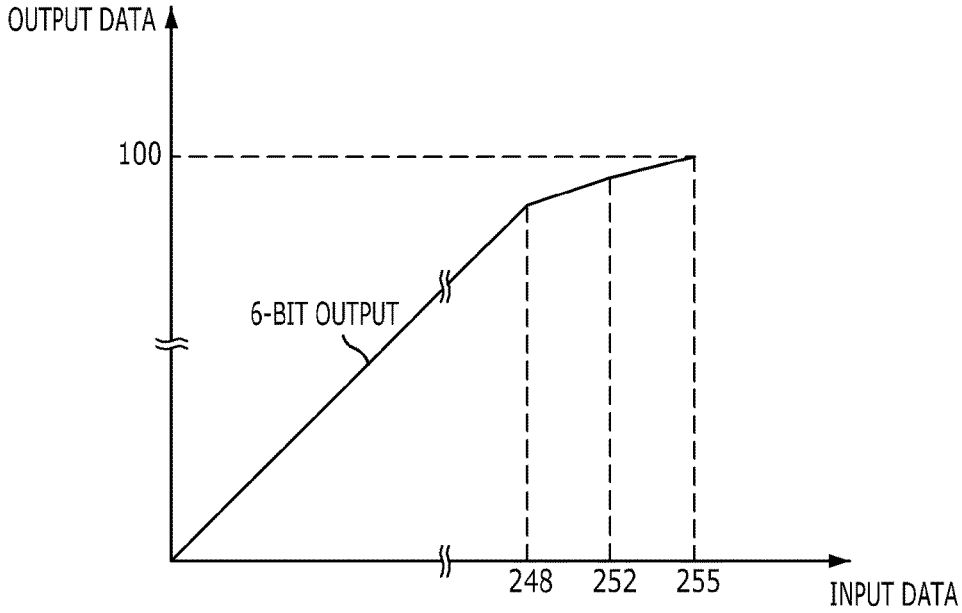
FIG. 10 illustrates a graph of data output performance according to a temporal/spatial compensation scheme in accordance with an embodiment of the present invention.

FIG. 10 illustrates a graph of data output performance when performing the dithering and normalizing output data in a range of 0 to 100 in accordance with an embodiment of the present invention. Referring to FIG. 10, when applying the embodiment of the present invention, it is noted that the gray level saturation does not occur in a gray level region having high luminance.

Figure 11:
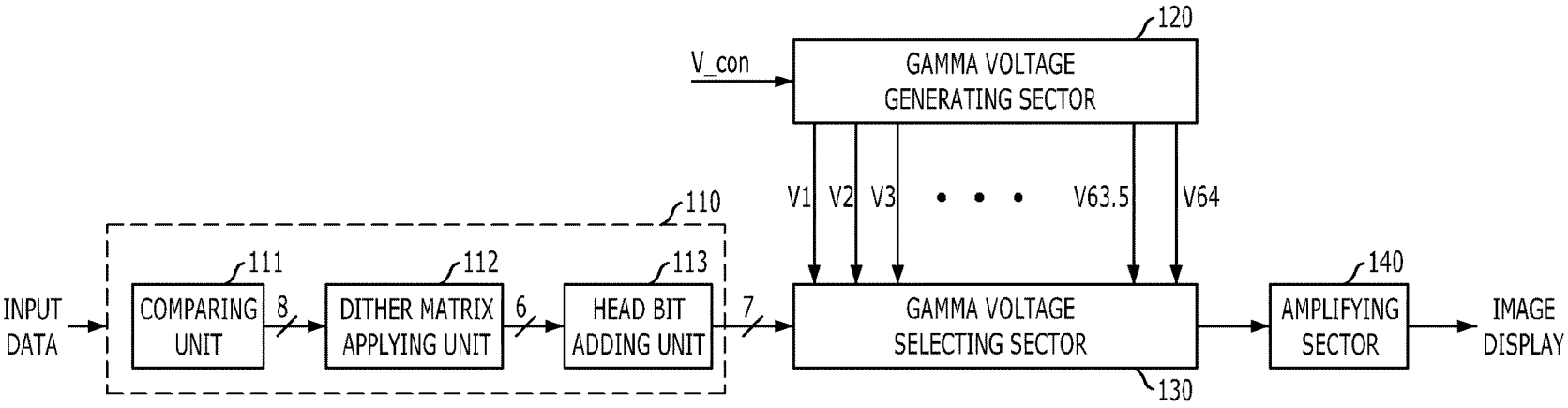
FIG. 11 illustrates a dithering apparatus in accordance with an embodiment of the present invention.

FIG. 11 illustrates a dithering apparatus in accordance with an embodiment of the present invention.

Referring to FIG. 11, the dither apparatus includes a compensation sector 110 for performing the temporal/spatial compensation according to a gray level of input data and adding a head bit to the data on which the temporal/spatial compensation is performed to thereby output dithering data, a gamma voltage generating sector 120 for generating a plurality of main gamma voltages and a dummy gamma voltage, and a gamma voltage selecting sector 130 for selecting the main gamma voltages or the dummy gamma voltage according to the dithering data. The dithering apparatus may further include an amplifying sector 140 for amplifying the gamma voltage selected by the gamma voltage selecting sector 130 and outputting the amplified gamma voltage to an image display.

The compensation sector 110 includes a comparing unit 111 for comparing the gray level of the input data with a preset reference gray level, a dither matrix applying unit 112 for performing the temporal/spatial compensation by applying a dither matrix to the input data, a head bit adding unit 113 for adding the head bit to the data one which the temporal/spatial compensation is performed according to control signals outputted from the comparing unit 111.

The comparing unit 111 compares the gray level of the input data with the preset reference gray level and outputs the control signals corresponding to the comparison result. The comparing unit 111 outputs the control signals corresponding to the case the gray level of the input data is smaller than or equal to the reference gray level and the case the gray level of the input data is greater than the reference gray level. For instance, the comparing unit 111 judges whether a gray level of an input video signal is smaller than or equal to, or greater than a 248 gray level in case the input data has 8 bits and higher bits are 6 bits.

The dither matrix applying unit 112 performs the temporal/spatial compensation using the dither matrix on the input data outputted from the comparing unit 111. When performing the temporal compensation, higher bits of the input data where the overflow is to occur are bypassed for their compensation regardless of lower bits and other higher bits than the higher bits where the overflow is to occur are compensated by adding a weight thereto according to the lower bits.

The head bit adding unit 113 generates the dithering data by adding the head bit to the data on which the temporal/spatial compensation is performed by the dither matrix applying unit 112 in respond to the control signals of the comparing unit 111. Herein, the head bit becomes the most significant bit of the dithering data. For instance, in case the gray level of the input data is smaller than or equal to the reference gray level, a binary number '0' is added as the head bit and, in other cases, i.e., the gray level of the input data is greater than the reference gray level, a binary number '0' or '1' is added as the head bit.

The gamma voltage generating sector 120 produces the plurality of main gamma voltages and the dummy gamma voltage. The dummy gamma voltage has a different voltage level among the plurality of main gamma voltages. The voltage level of the dummy gamma voltage may be appropriately selected in response to a control signal V_CON. Moreover, the dummy gamma voltage may include one or plural dummy gamma voltages existing among the plurality of main gamma voltages. For instance, the gamma voltage generating sector 120 generates $2^6$ numbers of main gamma voltages and one dummy gamma voltage when the input data has 8 bits and the higher bits of the input data are 6 bits. At this point, the main gamma voltages have voltage levels rising as going from $2^0$th to $2^6$th. The dummy gamma voltage has a voltage level existing between a $(2^6-1)$th main gamma voltage and the $2^{6th}$ main gamma voltage.

The gamma voltage selecting sector 130 includes a decoder and maps the dithering data outputted from the compensation sector 110 with the main gamma voltages V1 to V64 and the dummy gamma voltage V63.5 outputted from the gamma voltage generating sector 120. That is, one of the main gamma voltages V1 to V64 and the dummy gamma voltage V63.5 is selected and outputted according to the dithering data.

The gamma voltage selecting sector 130 selects one of the $2^0$th main gamma voltage V1 to the $(2^6-1)$th main gamma voltage V63 according to the higher bits on which the temporal/spatial compensation is performed in case the gray level of the input data is smaller than or equal to the preset reference gray level. In other cases, the gamma voltage selecting sector 130 selects one of the $(2^6-1)$th main gamma voltage V63, the dummy gamma voltage V63.5 and the $2^6$th main gamma voltage V64 according to the head bit.

The gamma voltage selecting sector 130 selects the $2^6$th main gamma voltage V64 in case the gray level of the input data is the $2^8$th gray level 255. Moreover, in case the gray level of the input data is the $(2^8-7)$th gray level 248, the $(2^6-1)$th main gamma voltage V63 is selected. In case the gray level of the input data is the $(2^8-3)$th gray level 252, the dummy gamma voltage V63.5 is selected. In case the gray level of the input data exists between the $(2^8-7)$th gray level 248 and the $(2^8-3)$th gray level 252, the $(2^6-1)$th main gamma voltage V63 or the dummy gamma voltage V63.5 is selected according to the dithering data.

In case the gray level of the input data exists between the $(2^8-3)$th gray level 252 and the $2^8$th gray level 255, the dummy gamma voltage V63.5 or the $2^6$th main gamma voltage V64 is selected according to the head bit. Preferably, in case the head bit is a binary number '0', the $2^6$th main gamma voltage V64 is selected. On the other hand, in case the head bit is a binary number '1', the dummy gamma voltage V63.5 is selected.

In accordance with the embodiments of the present invention, when generating the dithering data by adding the head bit to the data for which the temporal/spatial compensation is completed, and performing the dithering data mapping by adding the dummy gamma voltage besides the main gamma voltage, it is possible to solve the gray level saturation occurring in the prior art by selecting the main gamma voltage or the dummy gamma voltage using the head bit from a certain gray level. As a result, much better quality can be secured.

While the present invention has been described with respect to the specific embodiments, it will be apparent to those skilled in the art that various changes and modifications may be made without departing from the spirit and scope of the invention as defined in the following claims.

What is claimed is:

1. A dithering method, comprising:

performing the temporal/spatial compensation using a weight on input data in a manner of time-averaging during a plurality of frames;

generating dithering data by adding a head bit for adjusting gamma voltage to the data on which the temporal/spatial compensation is performed; and selecting a corresponding gamma voltage according to the dithering data, wherein the head bit added to the data is a binary number '0' in case a gray level of the input data is smaller than a first preset reference gray level; the head bit is a binary number '1' in case the gray level of the input data exceeds a second preset reference gray level; the second preset reference gray level is greater than a $(2^N-7)$th gray level where the input data has N bits.

2. The dithering method of claim 1, wherein the performing of the temporal/spatial compensation comprises:

compensating higher bits of the input data where the overflow is to occur when performing the temporal compensation by bypassing them regardless of lower bits of the input data; and compensating other higher bits than the higher bits of the input data where the overflow is to occur by adding a weight thereto according to the lower bits.

3. The dithering method of claim 2, wherein the head bit becomes the most significant bit of the dithering data.

4. The dithering method of claim 1, wherein the gamma voltage comprises a plurality of main gamma voltages and a plurality of dummy gamma voltages that has different voltage levels from those of the main gamma voltages.

5. The dithering method of claim 4, wherein, in case the input data has N bits and the higher bits are K bits, the number of the main gamma voltages is $2^K$, the main gamma voltages have voltage levels rising as going from $2^0$th to $2^K$th, and the dummy gamma voltages have voltage levels existing between a $(2^K-1)$th main gamma voltage and the $2^K$th main gamma voltage.

6. The dithering method of claim 5, wherein, in the selecting of the corresponding gamma voltage according to the dithering data, in case a gray level of the input data is smaller than or equal to a preset reference gray level, one of the $2^0$th to $(2^K-1)$th main gamma voltages is selected according to the dithering data and, in other case, one of the $(2^K-1)$th main gamma voltage, the dummy gamma voltage and the $2^K$th main gamma voltage is selected.

7. The dithering method of claim 5, wherein, in case a gray level of the input data is a $2^N$th gray level, the $2^K$th main gamma voltage is selected.

8. The dithering method of claim 5, wherein, in case a gray level of the input data is a $(2^N-7)$th gray level, the $(2^K-1)$th main gamma voltage is selected.

9. The dithering method of claim 5, wherein, in case a gray level of the input data is a $(2^N-3)$th gray level, the dummy gamma voltage is selected.

10. The dithering method of claim 5, wherein, in case a gray level of the input data is a gray level existing between a $(2^N-7)$th gray level and a $(2^N-3)$th gray level, the $(2^K-1)$th main gamma voltage or the dummy gamma voltage is selected according to the dithering data.

11. The dithering method of claim 5, wherein the dummy gamma voltage or the $2^K$th main gamma voltage is selected according to the head bit in case a gray level of the input data is a gray level existing between a $(2^N-3)$th gray level and a $2^N$th gray level; the $2^K$th main gamma voltage is selected in case the head bit is a binary number '0'; and the dummy gamma voltage is selected in case the head bit is a binary number '1'.

12. The dithering method of claim 5, wherein, in case a gray level of the input data exceeds a preset reference gray level, the dummy gamma voltage is selected, the preset reference gray level being greater than a $(2^N-7)$th gray level where the input data has N bits.

13. The dithering method of claim 1, wherein the performing of the temporal/spatial compensation comprises employing a dither matrix of a 4×4 form applying different patterns by pixel data channels.

14. The dithering method of claim 13, wherein a basic pattern is applied in case the pixel data channel is an R data channel; a pattern obtained by performing the vertical mirroring or the horizontal mirroring on the basic pattern is applied in case the pixel data channel is a G data channel; and a pattern obtained by performing frame-inversion on the pattern applied to the G data channel is applied in case the pixel data channel is a B data channel.

15. The dithering method of claim 1, further comprising amplifying the selected gamma voltage after the selecting of the corresponding gamma voltage.

16. A display device that performs dithering, comprising:

a compensation sector configured to perform the temporal/spatial compensation using a weight according to a gray level of input data in a manner of time-averaging during a plurality of frames and output dithering data by adding a head bit for adjusting gamma voltage to the data on which the temporal/spatial compensation is performed;

a gamma voltage generating sector configured to generate a plurality of main gamma voltages and a dummy gamma voltage; and a gamma voltage selecting sector configured to select the main gamma voltages or the dummy gamma voltage according to the dithering data, wherein the head bit added to the data is a binary number '0' in case the gray level of the input data is smaller than a first preset reference gray level; the head bit added to the data is a binary number '1' in case the gray level of the input data exceeds a second preset reference gray level; the second preset reference gray level is greater than the first preset reference gray level; the second preset reference gray level is greater than a $(2^N-7)$th gray level where the input data has N bit.

17. The display device of claim 16, wherein the compensation sector comprises:

a comparing unit configured to compare the gray level of the input data with a preset reference gray level;

a dither matrix applying unit configured to apply a dither matrix for the input data to perform the temporal/spatial compensation; and a head bit adding unit configured to add the head bit to the data on which the temporal/spatial compensation is performed in response to a control signal outputted from the comparing unit.

18. The display device of claim 17, wherein the dither matrix applying unit compensates higher bits of the input data where the overflow is to occur when performing the temporal compensation by bypassing the higher bits regardless of lower bits of the input data, and compensates other higher bits than the higher bits of the input data where the overflow is to occur by adding a weight to said other higher bits according to the lower bits.

19. The display device of claim 18, wherein the head bit becomes the most significant bit of the dithering data.

20. The display device of claim 18, wherein the gamma voltage generating sector produces a plurality of main gamma voltages and a plurality of dummy gamma voltages that has different voltage levels from those of the main gamma voltages.

21. The display device of claim 20, wherein the gamma voltage generating sector produces $2^K$ numbers of main gamma voltages and one dummy gamma voltage in case the input data has N bits and the higher bits of the input data are K bits, wherein the main gamma voltages have voltage levels rising as going from $2^0$th to $2^K$th and the dummy gamma voltage has a voltage level existing between a $(2^K-1)$th main gamma voltage and the $2^K$th main gamma voltage.

22. The display device of claim 21, wherein the gamma voltage selecting sector selects one of the $2^0$th to $(2^K-1)$th main gamma voltages according to the dithering data in case the gray level of the input data is smaller than or equal to the preset reference gray level, and selects one of the $(2^K-1)$th main gamma voltage, the dummy gamma voltage and the $2^K$th main gamma voltage in other case.

23. The display device of claim 21, wherein the gamma voltage selecting sector selects the $2^K$th main gamma voltage in case the gray level of the input data is a $2^N$th gray level.

24. The display device of claim 21, wherein the gamma voltage selecting sector selects the $(2^K-1)$th main gamma voltage in case the gray level of the input data is a $(2^N-7)$th gray level.

25. The display device of claim 21, wherein the gamma voltage selecting sector selects the dummy gamma voltage in case the gray level of the input data is a $(2^N-3)$th gray level.

26. The display device of claim 21, wherein the gamma voltage selecting sector selects the $(2^K-1)$th main gamma voltage or the dummy gamma voltage according to the dithering data in case the gray level of the input data is a gray level existing between a $(2^N-7)$th gray level and a $(2^N-3)$th gray level.

27. The display device of claim 21, wherein the gamma voltage selecting sector selects the dummy gamma voltage or the $2^K$th main gamma voltage according to the head bit in case the gray level of the input data is a gray level existing between a $(2^N-3)$th gray level and a $2^N$th gray level, the $2^K$th main gamma voltage in case the head bit is a binary number '0', and the dummy gamma voltage in case the head bit is a binary number '1'.

28. The display device of claim 21, wherein the gamma voltage selecting sector selects the dummy gamma voltage in case the gray level of the input data exceeds a preset reference gray level, the preset reference gray level being greater than a $(2^N-7)$th gray level where the input data has N bits.

29. The display device of claim 16, wherein the dither matrix has a 4×4 form.

30. The display device of claim 29, wherein the dither matrix applies different patterns by pixel data channels.

31. The display device of claim 30, wherein a basic pattern is applied in case the pixel data channel is an R data channel; a pattern obtained by performing the vertical mirroring or the horizontal mirroring on the basic pattern is applied in case the pixel data channel is a G data channel; and a pattern obtained by performing frame-inversion on the pattern applied to the G data channel is applied in case the pixel data channel is a B data channel.

32. The display device of claim 16, further comprising an amplifying sector configured to amplify the gamma voltage selected by the gamma voltage selecting sector and output the amplified gamma voltage to an image display.

33. The display device of claim 16, wherein the gamma voltage selecting sector comprises a decoder and the gamma voltage generating sector determines a voltage level of the dummy gamma voltage in response to a control signal.

34. A dithering method, comprising:

performing the temporal/spatial compensation using a weight on input data in a manner of time-averaging during a plurality of frames;

generating dithering data by adding a head bit for adjusting gamma voltage to the data on which the temporal/spatial compensation is performed; and selecting a corresponding gamma voltage according to the dithering data, wherein the gamma voltage comprises a plurality of main gamma voltages and a plurality of dummy gamma voltages that has different voltage levels from those of the main gamma voltages; and wherein, in case the input data has N bits and the higher bits are K bits, the number of the main gamma voltages is $2^K$, the main gamma voltages have voltage levels rising as going from $2^0$th to $2^K$th, and the dummy gamma voltages have voltage levels existing between a $(2^K-1)$th main gamma voltage and the $2^K$th main gamma voltage; and in case a gray level of the input data is a $(2^N-3)$th gray level, the dummy gamma voltage is selected.

35. The dithering method of claim 34, wherein, in case a gray level of the input data is smaller than or equal to a preset reference gray level, a binary number '0' is added as the head bit and, in other case, a binary number '0' or '1' is added.

* * * * *